US005389916A

United States Patent [19]

Chen et al.

[11] Patent Number: 5,389,916

[45] Date of Patent: Feb. 14, 1995

[54] SIMPLIFIED SHORTCIRCUITING AND CIRCUIT-BREAKING ALARM MEANS FOR PLANAR OR LINEAR CONDUCTORS

[76] Inventors: Sheng-Chuan Chen; Tieng-Fu Lin, both of C/O Hung Hsing Patent Service Center P.O. Box 55-1670, Taipei, Taiwan, Prov. of China

[21] Appl. No.: 82,711

[22] Filed: Jun. 28, 1993

[51] Int. Cl.[6] ..... G08B 21/00

[52] U.S. Cl. ..... 340/650; 340/571; 340/652; 200/61.93

[58] Field of Search ..... 340/650, 635, 652, 571, 340/541; 200/61.93

[56] References Cited

U.S. PATENT DOCUMENTS 4,023,157 5/1977 Miller ..... 340/571
5,200,734 4/1993 Lin ..... 340/508

*Primary Examiner*—Jeffery A. Hofsass

[57] ABSTRACT

A shortcircuiting and circuit-breaking alarm includes a Darlington amplifier comprised of two NPN transistors connected in series, a PNP transistor connected to the Darlington amplifier, a first planar or linear conductor connected between a base of a first NPN transistor of the Darlington amplifier and a positive pole of a power source, a second planar or linear conductor connected between the Darlington amplifier and the PNP transistor having an insulator interposed between the first conductor and the second conductor, the first NPN transistor having its base connected to the positive pole of the power source through a resistor of large resistance, and the PNP transistor having its base connected to a negative pole of a power source through a resistor of small resistance, whereby upon a cutting of either the first or the second conductor or a shortcircuiting of the two conductors, the PNP transistor will be conducted to conduct a silicon control rectifier, which is connected to a sounding integrated circuit provided with an alarming buzzer, to thereby sound the alarming buzzer for warning purpose.

9 Claims, 3 Drawing Sheets

SIMPLIFIED SHORTCIRCUITING AND CIRCUIT-BREAKING ALARM MEANS FOR PLANAR OR LINEAR CONDUCTORS

BACKGROUND OF THE INVENTION

U. S. Pat. No. 5,200,734 to Tieng-fu Lin, one of the co-inventors of this application disclosed a detecting and alarming system includes a main alarm circuit provided in a headquarter control center, at least a terminal alarm circuit provided at a local station, and at least a connecting loop conecting the main alarm circuit and each terminal alarm circuit, whereby upon a cutting or a shortcircuiting of the connecting loop between the headquarter control center and the local station, an alarm will be actuated for warning the breaking or shortcircuiting situation.

However, such a detecting and alarming system is merely used for gigantic security system, and not! suitable for a small alarm such as used in a handbag because it requires more complex structure and components of a large-scale security system as shown in the prior art.

Summary of the Invention:

The object of the present invention is to provide a shortcircuiting and circuit-breaking alarm including a Darlington amplifier comprised of two NPN transistors connected in series, a PNP transistor connected to the Darlington amplifier, a first planar or linear conductor connected between a base of a first NPN transistor of the Darlington amplifier and a positive pole of a power source, a second planar or linear conductor connected between the Darlington amplifier and the PNP transistor having an insulator interposed between the first conductor and the second conductor, the first NPN transistor having its base connected to the positive pole of the power source through a resistor of large resistance, and the PNP transistor having its base connected to a negative pole of a power source through a resistor of small resistance, whereby upon a cutting of either the first or the second conductor or a shortcircuiting of the two conductors, the PNP transistor will be conducted to conduct a silicon control rectifier, which is connected to a sounding integrated circuit provided with an alarming buzzer, to thereby sound the alarming buzzer for warning purpose.

DETAILED DESCRIPTION

Figure 1:
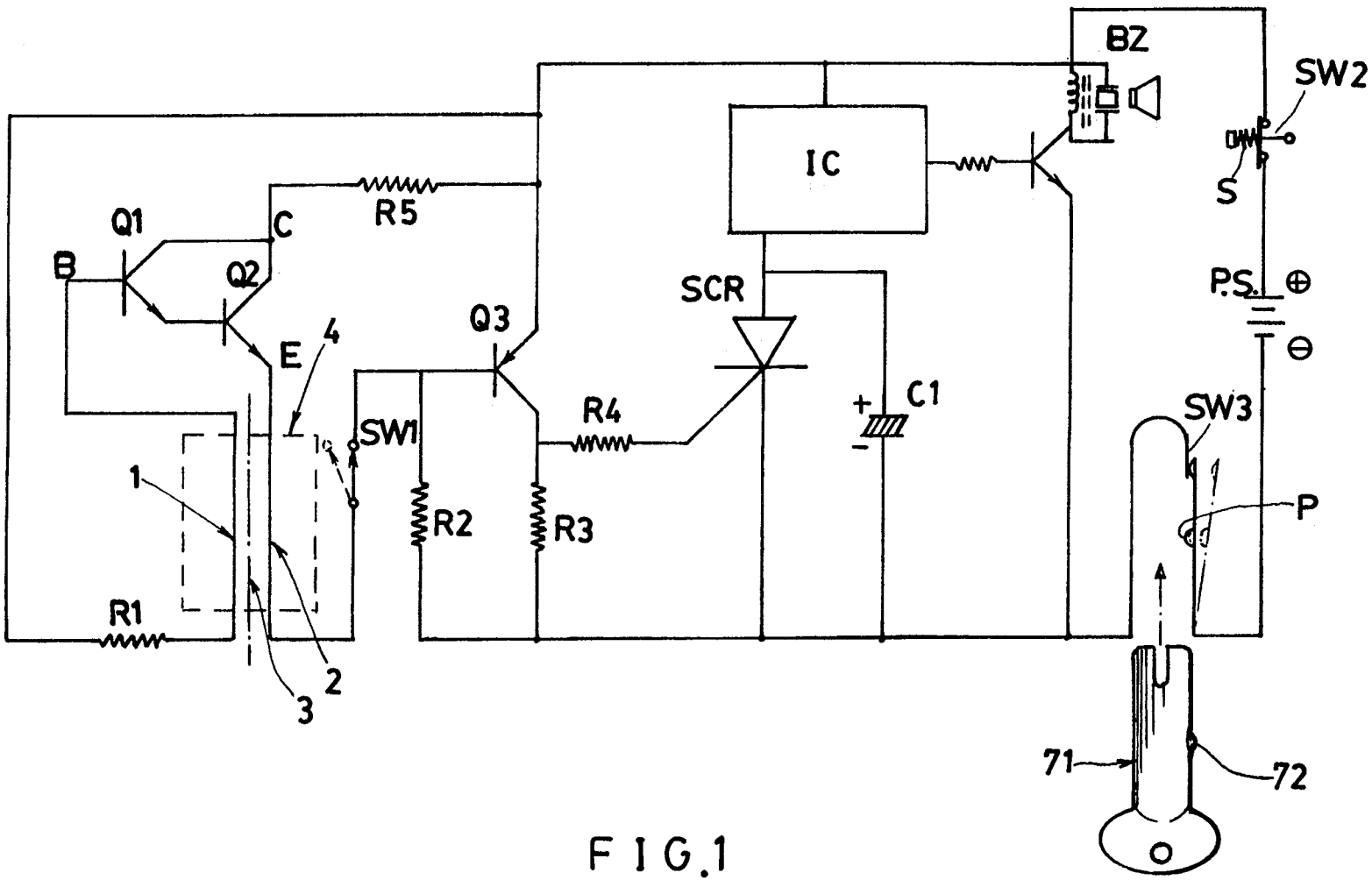
FIG. 1 is a circuit diagram of the present invention.

As shown in FIG. 1, the present invention comprises: a pair of NPN transistors Q1, Q2 connected in series to form a Darlington amplifier, a PNP transistor Q3 connected to the Darlington amplifier comprised of Q1, Q2, a silicon controlled rectifier SCR, a sounding integrated circuit IC having an alarming buzzer BZ secured thereto, a power source PS, a circuit-breaking switch SW1, an alarming-stopping switch SW2, and a key-operated interrupting switch SW3.

The Darlington amplifier includes a first NPN transistor Q1 having a base B thereof connected to a positive pole of power source PS through a large resistor R1 of larger resistance such as 450 Kilo-ohms, a second NPN transistor Q2 having a base of the second NPN transistor Q2 connected to an emitter of the first NPN transistor Q1, both first and second NPN transistors Q1, Q2 having their collectors C respectively connected to the positive pole of the power source PS, the second NPN transistor Q2 having its emitter E connected to a base of the PNP transistor Q3. A first conductor 1 either made as planar or linear conductor is connected between the base of the first NPN transistor Q1 and the positive pole of the power source PS, while a second conductor 2, either made as planar or linear conductor, is connected between an emitter E of the second NPN transistor Q2 and a base of the PNP transistor Q3, with the first conductor I being juxtapositioned to the second conductor 2 having an insulator 3 interposed between the two conductors 1, 2.

Figure 2:
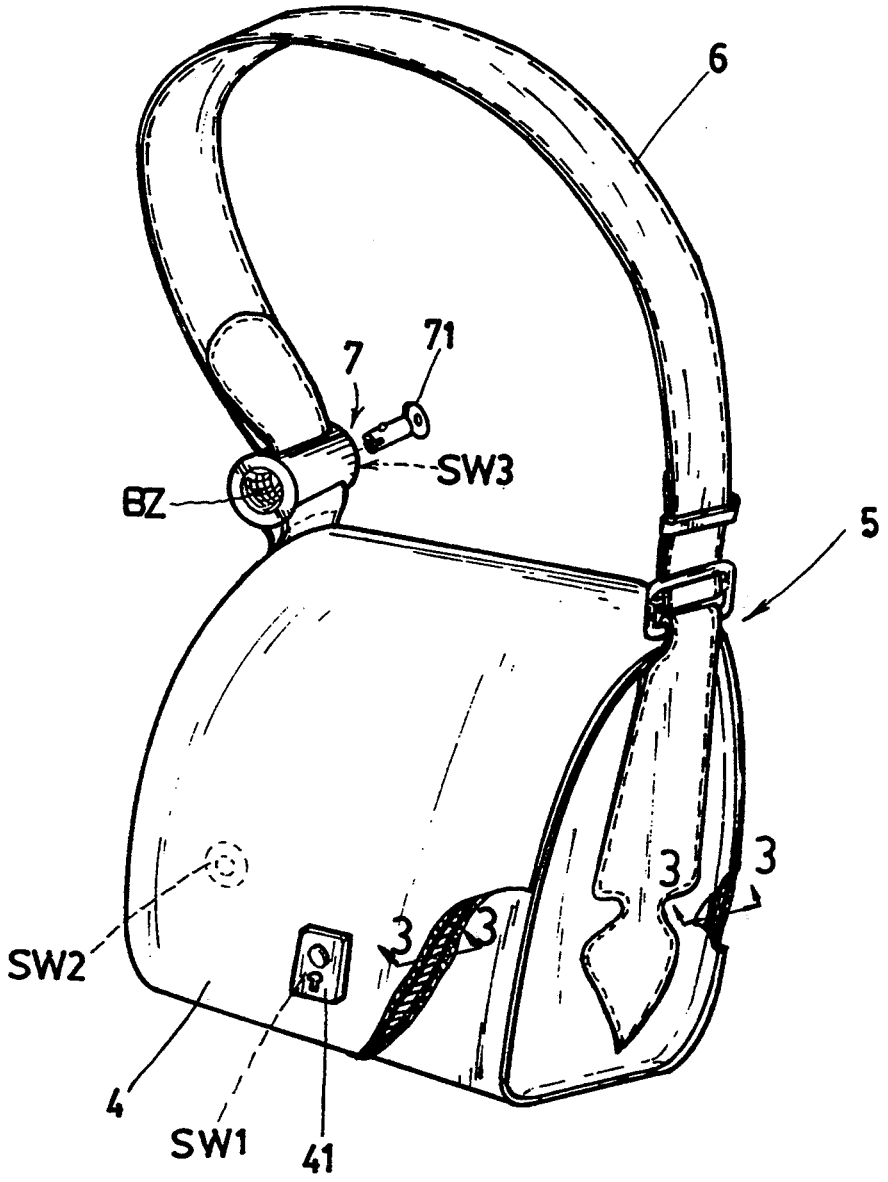
FIG. 2 is a perspective view of an utility application of the present invention.

The first conductor 1, the insulator 3, and the second conductor 2 are juxtapositionally clad in a detector body 4 of a protective object 5 such as a side-wall sleeve 4 of a hand bag 5, a purse, a brief case, etc. as shown in FIG. 2.

The hand bag 5 includes a belt 6 for handling or hanging purpose, and a housing 7 formed on the belt 6 or in the bag 5 for storing the transistor Q1, Q2, Q3, the SCR, the integrated circuit IC, the buzzer BZ, and a power source PS of batteries in the housing 7. The locations of the housing 7 are not limited.

The PNP transistor Q3 has its base connected to a negative pole of the power source PS through a small resistor or smaller resistance such as 3.3 kilo-ohms. The PNP transistor Q3 has its emitter connected to the positive pole of the power source PS and has its collector connected to a negative pole of the power source through a resistor R3 and has its collector parallelly connected to a gate of the silicon controlled rectifier SCR.

The silicon controlled rectifier SCR has a gate connected to the collector of the PNP transistor Q3 through a resistor R4, an anode of SCR connected to a grounding pin (negative pole) of the integrated circuit IC, and a cathode of SCR connected to the negative pole of the power source PS. A capacitor C1 is parallelly connected between the anode and the cathode of the SCR for keeping the SCR continuously conducted when SCR is triggered.

The pair of NPN transistors Q1, Q2 are connected in series to form a Darlington amplifier for outputing amplified current therefrom.

Under the condition of normal power supply, a positive biasing voltage through the large resistor R1 is directed to the base B of Q1 to conduct Q1 and Q2 to conduct the circuit between point C and E, to make the PNP transistor Q3 not conductive, thereby without triggering SCR and IC and without sounding the buzzer BZ.

However, when the first conductor 1 is cut or broken, there is no bias voltage supplied to the base Q1, the points C, E of Q2 is not conducted. However, a negative bias voltage will be supplied to the base of PNP transistor Q3 through the small resistor R2 to conduct the Q3, thereby triggering SCR and sounding alarm from buzzer BZ of integrated circuit IC. The sounding integrated circuit IC may be designed to produce voice warning or any other suitable voices.

When the second conductor 2 is interrupted, there is no B+ bias voltage of breaking current supplied from Q2 (points C, E) to the base of Q3 and a negative bias voltage from the negative pole of PS is supplied to the base of Q3 so that the Q3 is conducted to trigger SCR and to sound alarm of the integrated circuit IC.

A circuit-breaking switch SW1 may be further interposed or interpolated in the second conductor 2 (or the first conductor 1), which is normally closed and may be provided on the lock 41 of a hand bag 5 as shown in FIG. 2, whereby upon an opening of the cover 4 of the hand bag 5 such as opened by a pickpocket, it acts like a breaking of the circuit as aforementioned, to thereby sound the alarm for warning purpose.

When the first conductor I and the second conductor 2 is shortcircuited such as being electrically conducted as cut by a metal scissors or knife made of electrically conductive materials by a thief or pickpocket if the two conductors 1, 2 are disposed in the cover or side-wall sheets 4 of a hand bag 5 as shown in FIG. 2, the points B and E across the two transistors Q1, Q2 are shortcircuited to disconnect the circuit between point C and E and because the resistance of R1 is constantly larger than that of R2, a negative bias voltage through R2 will be supplied to the base of Q3 to conduct Q3, thereby triggering SCR and IC for sounding alarm through the buzzer BZ.

Figure 3:
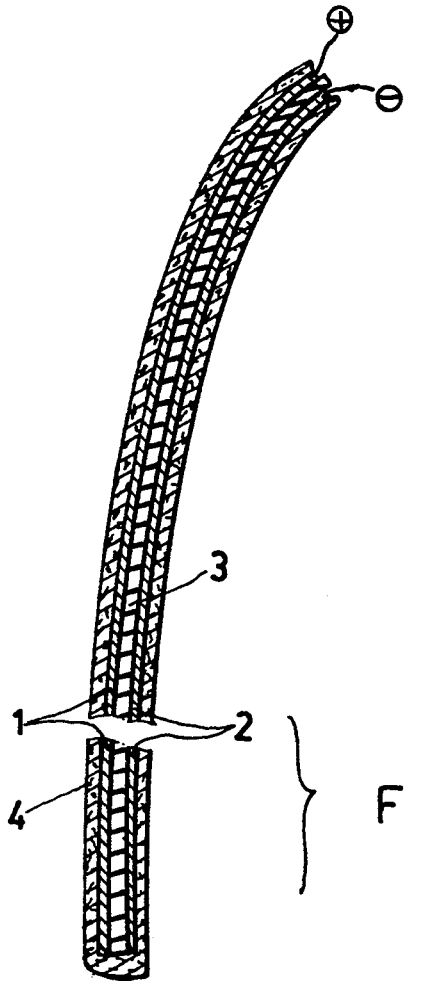
FIG. 3 is a partial sectional drawing of the present invention when viewed from either 3—3 direction of FIG. 2.

As shown in FIGS. 2, 3, each of the first and second conductors 1, 2 may be made as an electrically conductive thin layer or film, selected from: a metallic foil such as aluminum foil, an electrically conductive plastic "clothes" or knitting sheet, or thin-layer film coated with electrically conductive coating. The insulator 3 interposed between the two conductors 1, 2 should also be made as thin as possible to minimize the thickness of any sleeve or jacket 4 having the two conductors 1, 2 and the insulator 3 juxtapositionally clad in the sleeve or jacket 4 such as a cover or side-wall Sheet of a hand bag 5. The conductors 1, 2 are preferably distributed to occupy all surface areas of the hand bag 5 to easily sense any cutting or breaking actions to increase the alarming reliability or efficiency.

An alarm-stopping switch SW2 may be provided in this invention, which may be installed in any concealed places in the protective object 5 such as in the hand bag, whereby upon a depression of the alarm-stopping switch SW2 to stop the triggering of the SCR, the buzzer BZ will stop its alarm sounding. Upon releasing the switch SW2, a restoring spring of the switch SW2 will restore the switch SW2 for a normal-close condition ready for next depression use.

Figure 4:
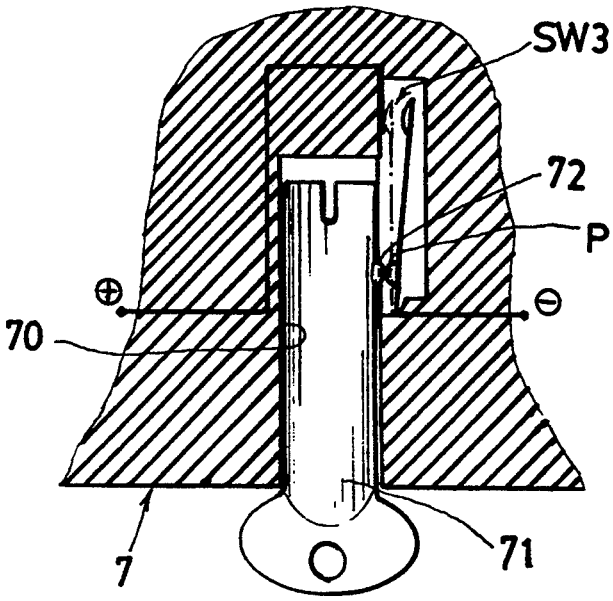
FIG. 4 shows a key-operated interrupting switch in accordance with the present invention.

As shown in FIGS. 1, 4, a key-operated interrupting switch SW3 is provided in this invention, which includes two resilient contacts normally closed to respectively connect two poles of the power source PS through the buzzer of the integrated circuit IC, one contact of the two contacts formed with a protrusion P thereon to be thrusted outwardly by a projection 72 formed on a key 71, when the key 71 is inserted in a key hole 70 formed in a housing 7 having the electronic parts of this invention mounted therein, so as to open the alarm circuit of this invention to prevent any unexpected panic alarm sounding when the owner of the hand bag 5 herself opens the hand bag by opening the lock 41.

The present invention may also be utilized in other conditions such as used in a motorcycle, in which two conductors 1, 2 of the invention may be outwardly "withdrawn" to be clad into a locking chain (not shown) for locking the wheel, for example, of the motorcycle by fastening the chain on a post or a building column, whereby upon an opening or cutting of the chain, the conductors 1, 2 will be broken to thereby trigger the SCR and IC (buzzer) to sound the alarm for warning purpose.

The present invention may be modified without departing from the spirit and scope of this invention.

We claim:

1. A shortcircuiting and circuit-breaking alarm means comprising:

a Darlington amplifier comprised of two NPN transistors, a PNP transistor connected to said Darlington amplifier, a first conductor connected between the base of the first NPN transistor of said Darlington amplifier and the positive pole of a power source through a large resistor having a large resistance, a second conductor connected between said Darlington amplifier and said PNP transistor having the base of said PNP transistor connected to a negative pole of said power source through a small resistor having a resistance smaller than that of said large resistor, said first and second conductors being juxtapositionally interposed by an insulator therebetween to serve as a detector body, a silicon controlled rectifier connected to said PNP transistor, and a sounding integrated circuit powered by said power source and electrically connected with a buzzer and connected to said silicon controlled rectifier, whereby upon a breaking of either said conductor or short circuiting of said two conductors, said PNP transistor is conductive to trigger said silicon controlled rectifier to sound the buzzer of said integrated circuit for an alarm warning purpose.

2. A shortcircuiting and circuit-breaking alarm means according to claim 1, wherein each said conductor of said first and second conductors is selected from a planar conductor and a linear conductor.

3. A shortcircuiting and circuit-breaking alarm means according to claim 2, wherein said two conductors interposed by an insulator therebetween are clad in a sleeve of a detector body of a protective object.

4. An alarm means according to claim 3, wherein said protective object is selected from: a handbag, a purse, a case, a bag and a container; and said detector body with a sleeve forming a side wall of said protective object for embedding said conductors and said insulator, made of thin-layer materials into said sleeve.

5. An alarm means according to claim 1, wherein said transistors, said integrated circuit, said silicon controlled rectifier, and said power source comprised of batteries are installed in a housing mounted on a protective object.

6. An alarm means according to claim 1, wherein said Darlington amplifier includes said first NPN transistor connected with the second NPN transistor in series, having the base of said first NPN transistor connected to said positive pole of said power source through said first conductor and said large resistor having a large resistance and having the emitter of said first NPN transistor connected to a base of said second NPN transistor, said second NPN transistor having the emitter thereof connected to the base of said PNP transistor through said second conductor, two collectors of said two NPN transistors connected to the positive pole of said power source; said PNP transistor having said base connected to the negative pole of said power source through a small resistor having a resistance smaller than that of said large resistor connected to said first NPN transistor, said PNP transistor having its emitter connected to said positive pole of said power source and having its collector respectively connected to the negative pole of said power source and connected to the gate a of silicon controlled rectifier for operatively triggering the same; said silicon controlled rectifier having the anode thereof connected to a grounding pin of said integrated circuit and the cathode connected to the negative pole of said power supply having a capacitor connected across the anode and the cathode of said silicon controlled rectifier for continuously conducting the silicon controlled rectifier once triggered, whereby upon a breaking of anyone of said first and said second conductors or a shortcircuiting between said two conductors, said PNP transistor is conductive to trigger said silicon controlled rectifier for sounding said buzzer of said integrated circuit.

7. An alarm means according to claim 6, wherein either said conductor is interpolated with a circuit-breaking switch SW1 in said conductor, which is normally closed and is formed on a lock of a cover of a protective object provided with said alarm means therein, whereby upon an unlocking of said lock for opening of said cover, said conductor is circuit-broken to actuate said integrated circuit for sounding a warning alarm.

8. An alarm means according to claim 7, wherein said protective object is provided with an alarm-stopping switch connected in said protective object for operatively opening a circuit between said integrated circuit and a power source for stopping an unexpected alarm from sounding.

9. An alarm means according to claim 6, wherein said transistors, said silicon controlled rectifier, said integrated circuit, and said power source are stored in a housing mounted on a protective object having a sleeve of each side wall of said protective object embedded or clad with said two conductors and said insulator therein for serving as a detector body, having a key-operated interrupting switch having two resilient contacts electrically connected between said integrated circuit and said power source, whereby upon an insertion of a key of said key-operated interrupting switch into a key hole of said housing to break the two contacts of said key-operated interrupting switch, a circuit of said alarm means will be opened to prevent any unexpected alarm sounding of said integrated circuit by an owner of said protective object.

* * * * *